US012685373B2

(12) United States Patent
Huang et al.

(10) Patent No.: US 12,685,373 B2
(45) Date of Patent: Jul. 21, 2026

(54) HAIRCARE APPLIANCE

(71) Applicant: Dyson Technology Limited, Wiltshire (GB)

(72) Inventors: Yuexiang Huang, Singapore (SG); Alvin Wei Mun Wong, Singapore (SG); Edward Sebert Maurice Shelton, Swindon (GB); Peter Dabbs, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 656 days.

(21) Appl. No.: 18/028,303

(22) PCT Filed: Sep. 16, 2021

(86) PCT No.: PCT/GB2021/052398

§ 371 (c)(1),
(2) Date: Mar. 24, 2023

(87) PCT Pub. No.: WO2022/069864

PCT Pub. Date: Apr. 7, 2022

(65) Prior Publication Data

US 2023/0380564 A1 Nov. 30, 2023

(30) Foreign Application Priority Data

Sep. 30, 2020 (GB) ..... 2015445
Jun. 22, 2021 (GB) ..... 2108914

(51) Int. Cl.
*A45D 1/04* (2006.01)
*A45D 1/06* (2006.01)

(52) U.S. Cl.
CPC ..... *A45D 1/04* (2013.01); *A45D 1/06* (2013.01)

(58) Field of Classification Search
CPC ..... A45D 1/04; A45D 1/06
(Continued)

(56) References Cited

U.S. PATENT DOCUMENTS 3,518,776 A * 7/1970 Wolff ..... A45D 20/10 34/621
4,197,448 A * 4/1980 Harigai ..... A45D 20/10 132/212
5,425,645 A 6/1995 Skovdal et al.
(Continued)

FOREIGN PATENT DOCUMENTS

CN 104411205 A 3/2015
CN 206744838 U 12/2017
(Continued)

OTHER PUBLICATIONS

International Search Report and Written Opinion received for PCT Patent Application No. PCT/GB2021/052398, mailed on Jan. 3, 2022, 11 pages.
(Continued)

*Primary Examiner* — Stephen M Gravini
(74) *Attorney, Agent, or Firm* — Tucker Ellis LLP; Michael G. Craig

(57) ABSTRACT

A haircare appliance has a heater housing, a heater assembly disposed in the heater housing, a circuitry housing remote from the heater housing, and an electronic component disposed in the circuitry housing. The haircare appliance has an electrical cable extending from the circuitry housing to the heater housing, a wire disposed within the electrical cable, the wire connecting the electronic component to the heater assembly, and an attachment member attaching the electrical cable to the circuitry housing. The attachment member has a main body having a bore within which the electrical cable is held. The attachment member has first and second arms extending from the main body, the first arm engaged with a first side of the circuitry housing, and the second arm engaged with a second side of the circuitry housing. The second side of the circuitry housing is opposite to the first side of the circuitry housing.

15 Claims, 8 Drawing Sheets

(58) Field of Classification Search
USPC ..... 34/95–100
See application file for complete search history.

(56) References Cited

U.S. PATENT DOCUMENTS

| | | | | | |
|---|---|---|---|---|---|
| 5,701,681 | A * | 12/1997 | Wonka | A45D 20/12 34/96 |
| 5,857,262 | A * | 1/1999 | Bonnema | F24H 3/0488 431/344 |
| 6,003,239 | A * | 12/1999 | Liebenthal | A45D 20/12 34/97 |
| 9,046,304 | B2 * | 6/2015 | Gulak | A47K 10/48 |
| 10,165,843 | B2 * | 1/2019 | Hedges | A45D 20/122 |
| 11,457,713 | B2 * | 10/2022 | Conrad | A45D 20/10 |
| 11,464,313 | B2 * | 10/2022 | Wang | A45D 20/12 |
| 11,832,698 | B2 * | 12/2023 | Wang | H05B 3/0033 |
| 2015/0335128 | A1 | 11/2015 | Larkin et al. | |
| 2023/0380564 | A1 * | 11/2023 | Huang | A45D 2/001 |
| 2023/0404236 | A1 * | 12/2023 | Courtney | A45D 20/12 |
| 2025/0325445 | A1 * | 10/2025 | Kim | A61H 39/086 |

FOREIGN PATENT DOCUMENTS

| | | | | | |
|---|---|---|---|---|---|
| CN | 110013098 | A | | 7/2019 | |
| CN | 116471960 | A | * | 7/2023 | A45D 1/10 |
| GB | 2599385 | A | | 4/2022 | |
| GB | 2599399 | A | * | 4/2022 | A45D 20/12 |
| JP | 61-032977 | A | | 2/1986 | |
| WO | 2007/132954 | A1 | | 11/2007 | |
| WO | 2022/069864 | A1 | | 4/2022 | |
| WO | WO-2022069855 | A1 | * | 4/2022 | A45D 20/12 |

OTHER PUBLICATIONS

Examination Report received for GB Application No. 2108914.9, mailed on Aug. 25, 2023, 3 pages.
Search Report received for GB Application No. 2015445.6, mailed on Feb. 22, 2021, 2 pages.
Search Report received for GB Application No. 2108914.9, mailed on Nov. 29, 2021, 2 pages.

* cited by examiner

HAIRCARE APPLIANCE

CROSS-REFERENCE TO PRIOR APPLICATION

This application is a § 371 National Stage Application of PCT International Application No. PCT/GB2021/052398 filed Sep. 16, 2021, which claims the priority of United Kingdom Application No. 2015445.6, filed Sep. 30, 2020, and United Kingdom Application No. 2108914.9, filed Jun. 22, 2021, each of which are herein incorporated by reference in their entirety.

FIELD OF THE INVENTION

The present invention relates to a haircare appliance.

BACKGROUND OF THE INVENTION

Haircare appliances are generally used to treat or style hair, and some haircare appliances may treat or style hair using airflow along with heat. Such haircare appliances are typically held by a user and moved relative to the hair to obtain desired treatment or styling.

SUMMARY OF THE INVENTION

According to a first aspect of the present invention there is provided a haircare appliance comprising a heater housing, a heater assembly disposed in the heater housing, a circuitry housing remote from the heater housing, an electronic component disposed in the circuitry housing, an electrical cable extending from the circuitry housing to the heater housing, a wire disposed within the electrical cable, the wire connecting the electronic component to the heater assembly, and an attachment member attaching the electrical cable to the circuitry housing, wherein the attachment member comprises a main body having a bore within which the electrical cable is held, and first and second arms extending from the main body, the first arm engaged with a first side of the circuitry housing, and the second arm engaged with a second side of the circuitry housing, the second side of the circuitry housing opposite to the first side of the circuitry housing.

The haircare appliance according to the first aspect of the present invention may be beneficial as the first and second arms are engaged with opposing sides of the circuitry housing, and this may provide a relatively even distribution of forces between the first and second sides of the circuitry housing in the presence of an applied force on the electrical cable, and hence on the attachment member, in use.

The electronic component may comprise an electronic component for providing electrical power to the heater. The electronic component may comprise any of a voltage converter, a filter, or a relay. The heater assembly may comprise a heater controller disposed in the heater housing, and the electronic component may comprise an electronic component for providing electrical power to the heater controller.

The haircare appliance may comprise a plurality of wires connecting a plurality of electrical components within the circuitry housing to a plurality of electrical components within the heater housing, each of the plurality of wires disposed in the electrical cable.

The haircare appliance may comprise an airflow generator disposed in the heater housing, airflow generator control circuitry disposed in the circuitry housing, and a further wire connecting the airflow generator control circuitry to the airflow generator, the further wire disposed within the electrical cable.

The circuitry housing may comprise a third side extending between, and orthogonal to, the first and second sides. The bore may be located in a plane parallel to the third side of the circuitry housing.

The first side of the circuitry housing may comprise a locating feature, and the first arm may be received within the locating feature such that motion of the attachment member relative to the circuitry housing in a direction parallel to a longitudinal extent of the electrical cable is inhibited.

This may be beneficial as it may inhibit separation of the attachment member, and hence the electrical cable, from the circuitry housing when a force is applied in a direction parallel to a longitudinal extent of the electrical cable in use, for example a pulling force applied to the electrical cable in a direction away from the circuitry housing. For example, the first arm may engage with a perimeter of the locating feature to inhibit separation of the attachment member, and hence the electrical cable, from the circuitry housing. Receiving the first arm within the locating feature may remove the need for a fastener to engage the first arm with the first side of circuitry housing, which may reduce a required number of components and/or cost.

A direction parallel to a longitudinal extent of the electrical cable may comprise a direction parallel to a longitudinal extent of the electrical cable when the electrical cable is taut between the heater housing and the circuitry housing, for example.

The locating feature may comprise a recess or aperture formed in the first side of the circuitry housing, and the first arm is located in the recess or aperture.

This may provide engagement between the first arm and the perimeter of the recess or aperture, which may inhibit separation of the attachment member, and hence the electrical cable, from the circuitry housing in the presence of an applied force on the electrical cable in use, for example an applied force in a direction parallel to a longitudinal extent of the electrical cable.

The locating feature, for example the recess or aperture, may comprise substantially the same dimensions as an end of the first arm received within the locating feature. The first arm may be received within the locating feature with a friction fit.

The locating feature, for example the recess or aperture, may comprise a perimeter in a plane orthogonal to the third side of the circuitry housing, for example a plane orthogonal to the bore.

The second arm may be engaged with the second side of the circuitry housing by a fastener extending through the second arm and the second side of the circuitry housing.

This may be beneficial as the fastener may inhibit separation of the attachment member, and hence the electrical cable, from the circuitry housing in the presence of an applied force on the electrical cable in use, whilst also inhibiting disengagement of the first arm from the first side of the circuitry housing, for example inhibiting removal of the first arm from within the locating feature, by inhibiting motion of the attachment member in a direction orthogonal to the first and second sides of the circuitry housing.

The fastener may extend in a direction orthogonal to the first and second sides of the circuitry housing, for example in a direction parallel to the third side of the circuitry housing. The fastener may extend in a direction orthogonal to a longitudinal extent of the electrical cable.

The second side of the circuitry housing may comprise a first through-hole, the second arm may comprise a second through-hole aligned with the first through-hole, and the fastener may extend through the first and second through-holes to engage the second arm with the second side of the circuitry housing. The fastener may, for example, comprise a screw or the like.

The first and second through-holes may comprise respective perimeters in planes parallel to the first side of the circuitry housing, for example in planes parallel to the plane in which the perimeter of the locating feature is oriented and/or in planes orthogonal to the third side of the circuitry housing.

A region of engagement between the first arm and the first side of the circuitry housing may be located opposite a region of engagement between the second arm and the second side of the circuitry housing.

This may provide a relatively even distribution of forces between the first and second sides of the circuitry housing in the presence of an applied force on the electrical cable, and hence on the attachment member, in use.

The locating feature may be located opposite the fastener, for example with the locating feature and the fastener sharing a common axis. The recess or aperture in the first side of the circuitry housing may be located opposite the first and second through-holes.

The circuitry housing may define an internal cavity, the main body may be located at a perimeter of the circuitry housing, and the first and second arms may extend into the internal cavity from the main body.

This may reduce the space taken up by the attachment member within the circuitry housing compared to, for example, an arrangement where the full attachment member is located at a position remote from the perimeter of the circuitry housing within the internal cavity of the circuitry housing. This may, for example, allow for an increased volume of circuitry to be housed in the circuitry housing.

The first arm may comprise a first end attached to the main body, a second end for engagement with the first side of the circuitry housing, and the first arm may be curved between the first and second ends.

This may be beneficial as a curved arm may take up less space within the circuitry housing than, for example, an arm comprising straight portions that are required to turn through 90 degrees.

The first arm may comprise an engagement feature, and the first side of the circuitry housing may comprise a lip extending upwardly from an inner surface of the first side of the circuitry housing, the engagement feature engaged with the lip such that motion of the attachment member relative to the circuitry housing in a direction parallel to a longitudinal extent of the electrical cable is inhibited.

This may be beneficial as it may inhibit separation of the attachment member, and hence the electrical cable, from the circuitry housing when a force is applied in a direction parallel to a longitudinal extent of the electrical cable in use, for example a pulling force applied to the electrical cable in a direction away from the circuitry housing.

The engagement feature and the lip may comprise opposing flat surfaces. The engagement feature may comprise a step formed in the first arm, the step shaped to engage the lip.

The first side of the circuitry housing may comprise an engagement clip, the first arm held by the engagement clip such that motion of the attachment member is inhibited in a direction from the first side of the circuitry housing to the second side of the circuitry housing.

This may be beneficial as it may inhibit separation of the attachment member, and hence the electrical cable, from the circuitry housing when a force is applied in a direction orthogonal to a longitudinal extent of the electrical cable in use.

The second end of the first arm may be held within the locating feature, a first surface between the first and second ends of the first arm may be engaged with the lip, and a second surface between the first and second ends of the first arm may be held by the engagement clip. Such a multi-point interaction may provide a secure engagement between the first arm and the first side of the circuitry housing.

The circuitry housing may comprise a first portion defining the first side of the circuitry housing, a second portion defining the second side of the circuitry housing, and the engagement of the first arm with the first side of the circuitry housing, and the engagement of the second arm with the second side of the circuitry housing, may inhibit separation of the first and second portions.

Use of a circuitry housing having first and second portions may provide for ease of manufacture, whilst the engagement of the first arm with the first side of the circuitry housing and the engagement of the second arm with the second side of the circuitry housing may prevent the first and second portions from detaching in use, for example detaching in a direction orthogonal to a longitudinal extent of the cable.

The first and second portions may be joined together by at least one fastener, for example at least one clip or the like. Holding of the first arm by the engagement clip of the first side of the circuitry housing, and the action of the fastener to engage the second arm with the second side of the circuitry housing, may inhibit separation of the first and second portions.

The attachment member may comprise a plurality of first arms engaged with the first side of the circuitry housing.

This may provide increased engagement between the attachment member and the first side of the circuitry housing, which may inhibit separation of the attachment member, and hence the electrical cable, from the circuitry housing when a force is applied in a direction parallel to a longitudinal extent of the electrical cable in use, for example a pulling force applied to the electrical cable in a direction away from the circuitry housing.

Each of the plurality of first arms may be received within a respective locating feature on the first side of the circuitry housing. This may be beneficial as it may further inhibit separation of the attachment member, and hence the electrical cable, from the circuitry housing when a force is applied in a direction parallel to a longitudinal extent of the electrical cable in use, for example a pulling force applied to the electrical cable in a direction away from the circuitry housing.

A first first arm may be located on a first side of the bore, and a second first arm may be located on a second side of the bore opposite to the first side of the bore.

This may inhibit separation of the attachment member, and hence the electrical cable, from the circuitry housing when a force is applied in a direction non-parallel to a longitudinal extent of the electrical cable in use, for example a pulling force applied to the electrical cable in a direction away from the circuitry housing that is obliquely angled relative to the circuitry housing.

The bore may comprise a central axis, and the first and second sides of the bore may be located on opposing sides of the central axis. The central axis may comprise an axis extending through a centre-point of the bore in a plane parallel to the bore. The central axis may extend substantially orthogonally to the first and second sides of the circuitry housing. The first and second first arms may be located equidistantly from the central axis.

The attachment member may comprise a third arm engaged with the second side of the circuitry housing, the third arm comprising substantially the same engagement mechanism as the first arm.

This may increase engagement of the attachment member with the second side of the circuitry housing relative to an arrangement that solely utilises the second arm to engage the circuitry housing. The second arm may be located on the first side of the bore, and the third arm may be located on the second side of the bore. The engagement between the third arm and the second side of the circuitry housing may be located opposite the engagement between one of the plurality of first arms and the first side of the circuitry housing. A region of engagement between the first first arm and the first side of the circuitry housing may be located opposite a region of engagement between the second arm and the second side of the circuitry housing, and a region of engagement between the second first arm and the first side of the circuitry housing may be located opposite a region of engagement between the third arm and the second side of the circuitry housing. In such a manner the first arms, second arm, and third arm may be distributed about the periphery of the main body, and hence the bore, which may inhibit separation of the attachment member, and hence the electrical cable, from the circuitry housing when forces are applied to the electrical cable in multiple directions.

The attachment member and the circuitry housing may each comprise a thermally conductive material.

This may aid with heat dissipation from circuitry contained within the circuitry housing. The attachment member and/or the circuitry housing may comprise a metallic material. This may provide a robust circuitry housing and attachment of the electrical cable to the circuitry housing, whilst also aiding with heat dissipation.

The attachment member may comprise a stress release feature for absorbing stress applied to the electrical cable. The stress release feature may comprise a plurality of deformable ribs, each rib configured to deform and contact an adjacent rib in the presence of an applied force to the electrical cable. The stress release feature may be overmoulded onto the attachment member.

The circuitry housing may be an in-line housing i.e. a housing that connects between two wires with the heater housing at the distal end of one of the wires and a plug at the distal end of the other one of the wires. Alternatively, the circuitry housing may be formed as part of a plug unit which plugs into a socket for receiving a power source for the appliance.

According to a second aspect of the present invention there is provided an attachment member for attaching an electrical cable to a circuitry housing of a haircare appliance, the attachment member comprising a main body having a bore for holding the electrical cable, and first and second arms extending from the main body, the first arm for engagement with a first side of the circuitry housing, and the second arm for engagement with a second side of the circuitry housing, the second side of the circuitry housing opposite to the first side of the circuitry housing.

Optional features of aspects of the present invention may be equally applied to other aspects of the invention, where appropriate.

DETAILED DESCRIPTION OF THE INVENTION

Figure 1:
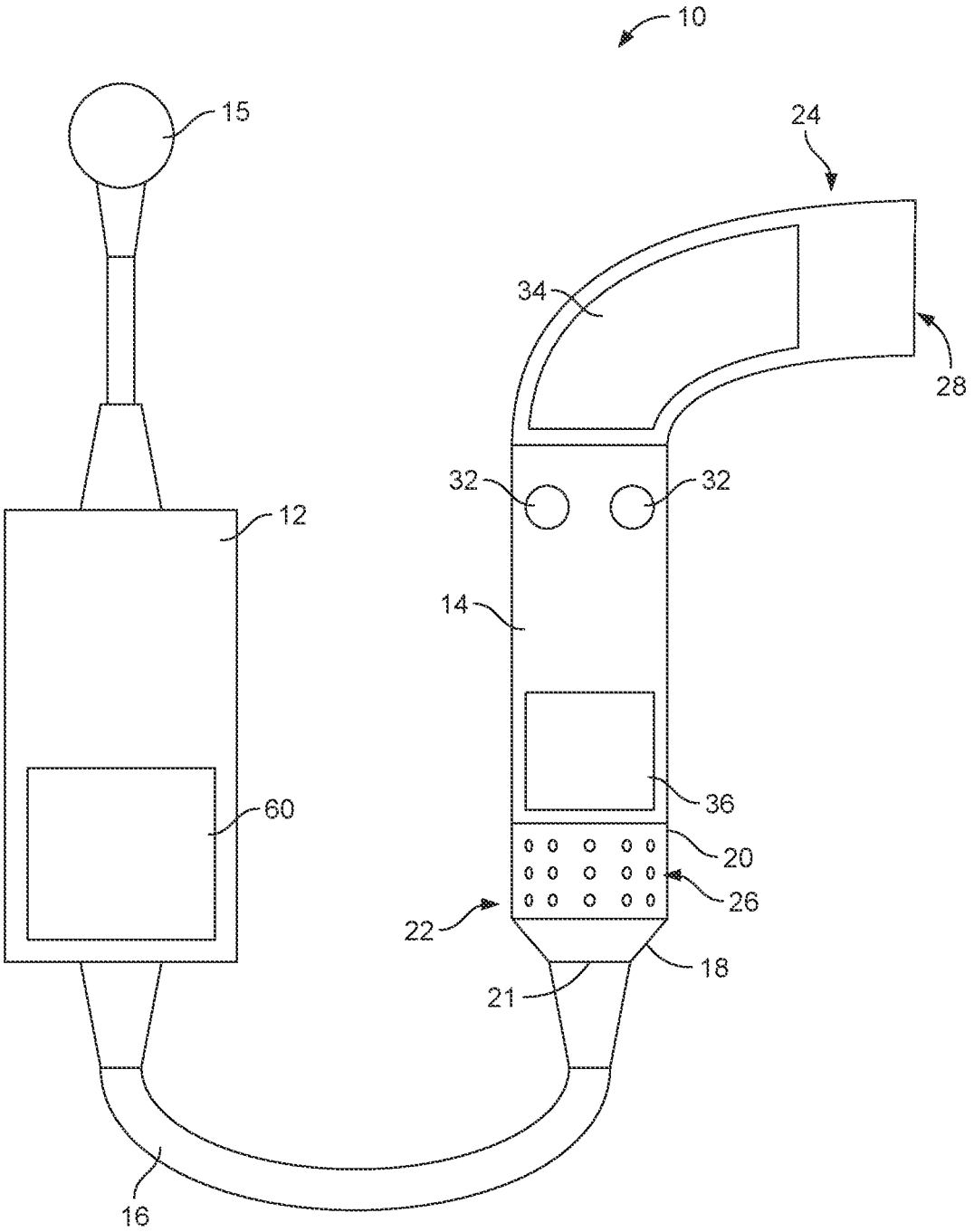
FIG. 1 is a perspective view of an embodiment of a haircare appliance.
Figure 2:
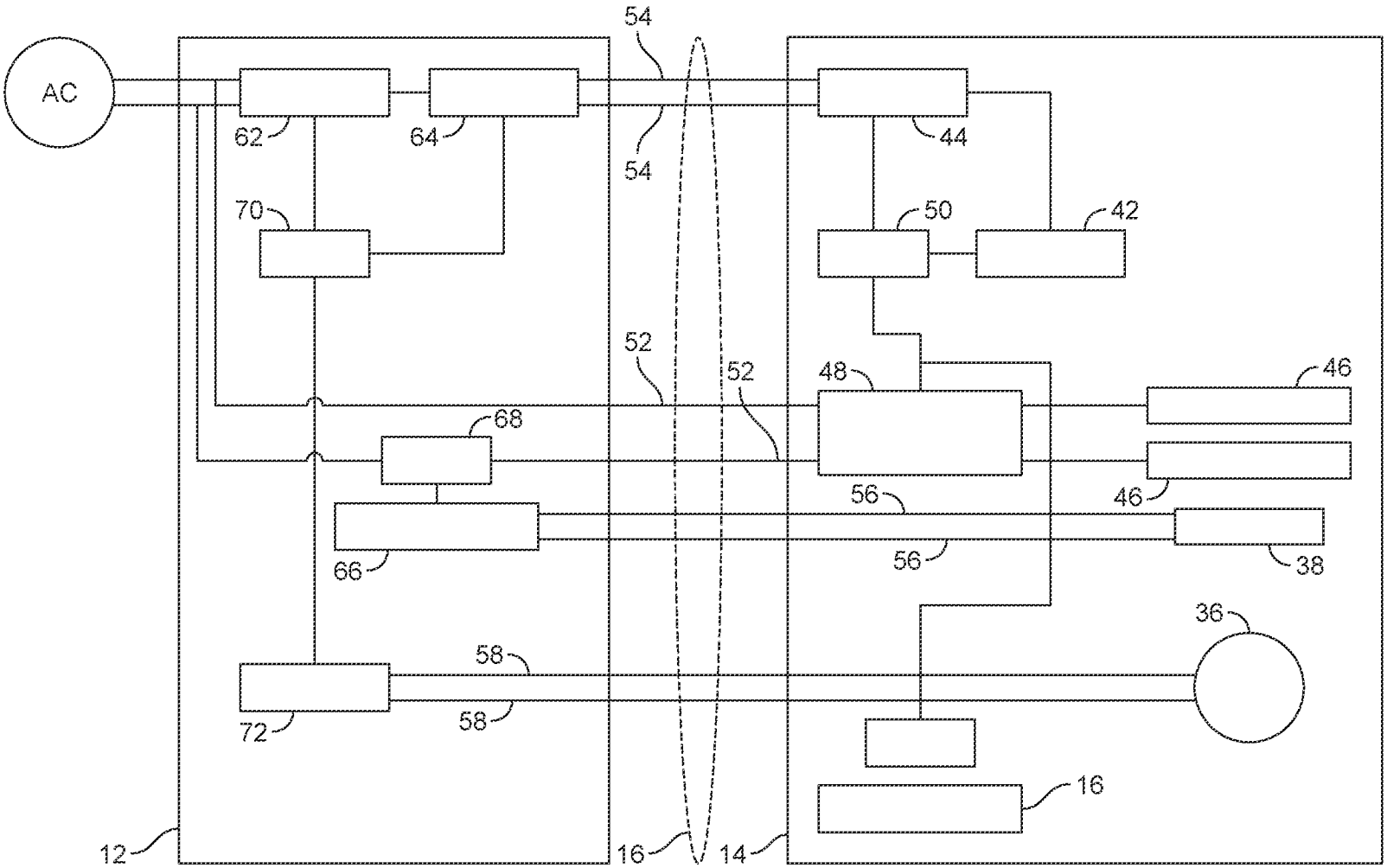
FIG. 2 is a schematic view illustrating internal components of the haircare appliance of FIG. 1.

A haircare appliance, generally designated 10, is shown schematically in FIGS. 1 and 2. The haircare appliance 10 in the embodiment of FIGS. 1 and 2 is a hairdryer, although it will be appreciated that some of the teachings discussed herein may be applied to other types of haircare appliance, for example hair straighteners or hair curlers or the like.

The haircare appliance 10 comprises a circuitry housing 12, a heater housing 14, and an electrical cable 16 extending from the circuitry housing 12 to the heater housing 14. The circuitry housing 12 defines an enclosure that houses a number of electronic components as will be described hereinafter, and the electronic components within the circuitry housing 12 are coupled to corresponding electronic components within the heater housing 14 by wires held within the electrical cable 16. Whilst referred to as wires, it will be appreciated that each wire may comprise more than one electrically conducting filament, for example as is the case with a braided wire, with the overall structure of multiple filaments being considered a wire. A power connector 15 in the form of a plug is coupled to the opposite side of the circuitry housing 12 to the electrical cable 16. The power connector 15 is configured to interact with an AC mains power supply, for example via a mains socket, to provide electrical current to the haircare appliance 10 in use.

The heater housing 14 defines a hollow, generally elongate, handle that is intended to be grasped by a user in use. As seen in FIG. 1, the heater housing 14 comprises a conical end portion 18 and a wall 20 extending upwardly from the conical end portion 18, such that a first end 22 of the heater housing 14 is generally cylindrical in form. The heater housing 14 has a second end 24 distal from the first end 22, and the heater housing 14 is curved such that the second end 24 is angled relative to the first end 22. An air inlet 26 is located at the first end 22 of the heater housing 14 on the wall 20, and takes the form of a plurality of apertures, for example in a mesh-like structure. An air outlet 28 is located at the second end 24, and comprises an aperture through which air may flow in use. The electrical cable 16 enters the heater housing 14 through an aperture 19 (see FIG. 10) formed in the conical end portion 18, for example in a circular base 21 of the conical end portion 18. A user interface 32 is formed on the wall 20, and may take the form of a plurality of buttons, a touchscreen, or a combination thereof.

Disposed within the heater housing 14 are a heater assembly 34, an airflow generator 36, a temperature sensor 38, a user interface controller 40, a DC-DC converter 42, and a first set of communications circuitry 44. The heater assembly 34 comprises two heater elements 46, heater drive circuitry 48, and a heater controller 50. The form of the heater drive circuitry 48 is dependent upon a desired control scheme of the heater assembly 34, as will be appreciated by a person skilled in the art, and hence the specific form of the heater drive circuitry 48 may vary depending upon the heater elements 46 used, for example. The heater controller 50 as discussed herein is configured to operate the heater drive circuitry 48 using a burst-fire control scheme, a phase angle control scheme, or a combination thereof, to control current flow to the heater elements 46. In such embodiments, the heater drive circuitry 48 typically comprises a plurality of TRIACs used to control current flow to the heater elements 46 depending on an output of the heater controller 50.

The heater controller 50 is coupled to the user interface controller 40, such that the heater controller 50 can react to desired settings input via the user interface 32 and control the heater drive circuitry 48 accordingly.

The heater drive circuitry 48 is electrically coupled to the power supply connector 15 by a pair of power supply wires 52 that extend within the electrical cable 16 and through the circuitry housing 12. In some embodiments an input filter (not shown), for example comprising a capacitor or the like, is disposed between the pair of power supply wires 52 and the power supply connector 15 within the circuitry housing 12. The pair of power supply wires 52 comprise a live wire and a neutral wire.

The heater controller 50 is configured to be powered by low voltage DC electrical power supplied by the DC-DC converter 42. The DC-DC-converter 42 is configured to receive a DC voltage from the circuitry housing 12, for example from an AC-DC converter 62 housed within the circuitry housing 12, and to step-down the received DC voltage to a voltage level appropriate for operation of the heater controller 50. The architecture of such a DC-DC converter may comprise any common DC-DC converter architecture, for example a common step-down or buck converter architecture including a switch, a diode, an inductor, and a capacitor. The DC-DC converter 42 is electrically coupled to the AC-DC converter 62 in the circuitry housing 12 via a pair of communication wires 54 that extend within the electrical cable 16. The pair of communication wires 54 are referred to as such as they also enable sending and receiving of communication signals between the circuitry housing 12 and the heater housing 14.

In particular, the heater controller 50 is configured to communicate with one or more microcontrollers disposed within the circuitry housing 12, as will be described hereafter. The heater controller 50 is configured to pass a communication signal to the first set of communications circuitry 44. The first set of communications circuitry 44 is configured to encode and inject a communication signal onto the pair of communication wires 54, and in some embodiments also to decode a communication signal received via the pair of communication wires 54.

The temperature sensor 38 comprises an RTD sensor positioned and configured to provide an indication of the temperature of the heater elements 46. The temperature sensor 38 is electrically coupled to a thermal protection circuit 66 disposed within the circuitry housing 12 by a pair of thermal protection circuit wires 56 that extend within the electrical cable 16.

The airflow generator 36 comprises an airflow generator capable of generating an airflow within the heater housing 14, from the air inlet 26 to the air outlet 28 in use. An example of an appropriate airflow generator 36 is a motor comprising a driven impeller. One such motor is the V9 Dyson Digital Motor of Dyson Technology Limited, details of which can be found in published PCT patent application WO2017098202A1, for example. Such a motor is a single-phase brushless permanent-magnet motor. The airflow generator 36 is electrically coupled to airflow generator control circuitry 60 disposed within the circuitry housing 12 by a pair of motor current wires 58 that extend within the electrical cable 16.

Disposed within the circuitry housing 12 are airflow generator control circuitry 60, an AC-DC converter 62, a second set of communications circuitry 64, a thermal protection circuit 66, and a relay 68.

The airflow generator control circuitry 60 comprises airflow generator drive circuitry 70 and an airflow generator controller 72. Specifics of the airflow generator drive circuitry 70 depend on the airflow generator 36 used, but where the airflow generator 36 comprises a brushless permanent-magnet motor, such as the V9 Dyson Digital Motor of Dyson Technology Limited, the airflow generator drive circuitry 70 comprises a plurality of switches in the form of FETs arranged in a bridge formation.

Switches may be considered as relatively large electronic components. By locating the airflow generator drive circuitry within the circuitry housing 12, as opposed to within the heater housing 14, the heater housing 14 may be made smaller and/or lighter, or alternatively space may be made available within the heater housing 14. This does, however, necessitate use of the pair of motor current wires 58 to deliver phase current to the airflow generator 36 within the heater housing 14.

As briefly mentioned above, the V9 Dyson Digital Motor of Dyson Technology Limited is a single-phase motor. Use of a single-phase motor may reduce the number of wires required to extend from the circuitry housing 12 to the heater housing 14 compared to, for example a similar arrangement where a three-phase motor is utilised as the airflow generator 36 within the heater housing 14. Fewer wires may reduce a thickness of the electrical cable 16, which may provide increased flexibility and range of motion when the heater housing 14 is grasped by a user in use. This may provide an improved user experience.

That being said, it will be appreciated that a three-phase motor may still be used to obtain a smaller and/or lighter heater housing 14, albeit at the cost of an electrical cable 16 of reduced flexibility.

The V9 Dyson Digital Motor of Dyson Technology Limited is also controlled using what is known as a "sensorless" control scheme, ie a control scheme that estimates a position of the rotor of the motor without using a position sensor such as a Hall sensor. A "sensorless" control scheme may calculate a rotational position of the rotor, and hence also impeller, of the motor using current and/or voltage values communicated to the airflow generator control circuitry over the pair of motor current wires 58. This may reduce the number of wires required compared to, for example, a similar arrangement that utilises a Hall sensor to calculate rotor position, and, as discussed above, fewer wires may reduce a thickness of the electrical cable 16, which may provide increased flexibility and range of motion when the heater housing 14 is grasped by a user in use. This may provide an improved user experience.

Details of appropriate "sensorless" control schemes will not be discussed herein for the sake of brevity, but a suitable "analog sensorless" control scheme is disclosed in published PCT patent application WO2013132247A1, whilst details of an appropriate "digital sensorless" control scheme can be found in GB patent application no. 1904290.2.

The airflow generator drive circuitry 70 is configured to supply DC current to the airflow generator 36 via the pair of motor current wires 58, with the airflow generator drive circuitry 70 controlled by the airflow generator controller 72, which may comprise any appropriate microcontroller. The AC-DC converter 62 comprises a rectifier, for example a diode bridge rectifier, and is coupled to the power connector 15 such that the AC-DC converter 62 is coupled to the AC mains power supply in use. The AC-DC converter 62 supplies the airflow generator drive circuitry 70 with DC current, and also supplies DC current to the DC-DC converter 42 via the pair of communication wires 54.

The airflow generator controller 72 is communicatively coupled to the heater controller 50 via the pair of communication wires 54, and the second set of communications 64 is configured to decode a communication signal received via the pair of communication wires 54, and in some embodiments also to encode and inject a communication signal onto the pair of communication wires 54. As the pair of communication wires 54 are used both to transfer electrical power from the AC-DC converter 62 to the DC-DC converter 42 and to provide communication signals between the heater controller 50 and the airflow generator controller 72, the number of wires extending within the electrical cable 16 may be reduced compared to, for example, a similar arrangement where separate pairs of power wires and communication wires are utilised. Fewer wires may reduce a thickness of the electrical cable 16, which may provide increased flexibility and range of motion when the heater housing 14 is grasped by a user in use. This may provide an improved user experience.

To achieve communication between the heater controller 50 and the airflow generator controller 72, the haircare appliance 10 utilises carrier modulated low voltage differential signalling. In this method, a controller modulates a carrier with data, and a signal is injected onto a low voltage transport wire-pair differentially. Circuitry at the other end of the transport wire-pair filters the signal, performs differential extraction, and demodulates the signal. Appropriate circuitry for the transmission and receipt of low voltage differential signals, for example embodiments of the first 44 and second 64 sets of communications circuitry are shown in FIG. 3.

Figure 3:
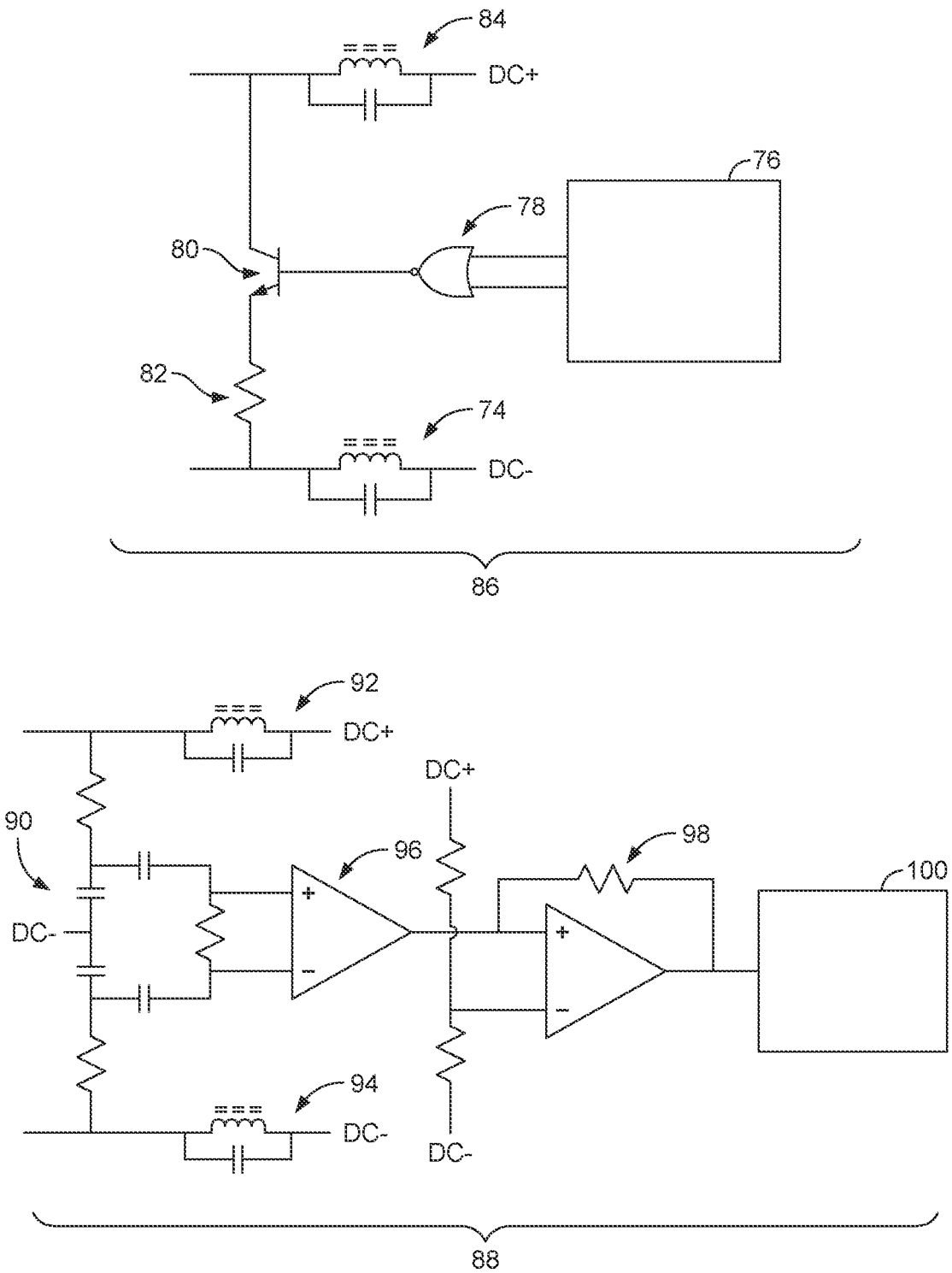
FIG. 3 illustrates communication circuitry of the haircare appliance of FIG. 1.

As seen in FIG. 3, transmission circuitry 74 of the first 44 and second 64 sets of communication circuitry comprises a controller 76, a NOR gate 78, a transistor 80, a resistor 82, and first 84 and second 86 filters. In some embodiments the controller 76 may comprise a separate controller to the heater controller 50, whereas in other embodiments the heater controller 50 may be used as the controller 76 of the transmission circuitry 74. The controller 76 generates a carrier signal, in this case having a frequency of around 980 kHz, and also generates data to be sent using universal asynchronous receiver-transmitter (UART) hardware. The data modulates the carrier signal on and off, eg via on-off-keying (OOK), and the gate of the transistor 80 is controlled by the output of the NOR gate 78 to inject a communication signal onto the pair of communication wires 54. The resistor 82 is used to set the amplitude of the communication signal, whilst the first 84 and second 86 filters prevent the communication signal from being passed to the power system within the heater housing 14, ie prevent the communication signal from being passed to the DC-DC converter 42. As shown in FIG. 3 the first 84 and second 86 filters each comprise a capacitor connected in parallel with an inductor.

Receiving circuitry 88 of the first 44 and second 64 sets of communication circuitry comprises a low pass filter 90, first 92 and second 94 power filters, extraction circuitry 96, demodulation circuitry 98, and a controller 100. The low pass filter 90 comprises a plurality of capacitors for removing high frequency noise from the signal, whilst the first 92 and second 94 power filters prevent the communication signal from being passed to the power system within the circuitry housing 12, ie prevent the communication signal from being passed to the AC-AC converter 62. As shown in FIG. 3 the first 92 and second 94 power filters each comprise a capacitor connected in parallel with an inductor. It will be appreciated that the power filters 92,94 may not be necessary in embodiments where the transmission circuitry 74 has the first 84 and second 86 filters, and vice versa, such that only one of the transmission circuitry 74 and the receiving circuitry 88 has appropriate filters to prevent the communication signal from being passed to the power system of the haircare appliance 10.

The extraction circuitry 96 comprises a comparator for extracting the differential signal back to a ground referenced signal, whilst the demodulation circuitry 98 comprises a comparator and a plurality of resistors for removing the carrier frequency from the signal. The controller 100 then receives data via UART hardware. In some embodiments the controller 100 may comprise a separate controller to the airflow generator controller 72, whereas in other embodiments the airflow generator controller 72 may be used as the controller 100 of the receiving circuitry 88.

It will be appreciated that in some embodiments, for example where two-way communication is desired between the heater controller 50 and the airflow generator controller 72, the first 44 and second 64 sets of communication circuitry may each comprise transmission circuitry 74 and receiving circuitry 88, whilst in other embodiments, for example where only one-way communication is desired from the heater controller 50 to the airflow generator controller 72, the first set of communication circuitry 44 may comprise transmission circuitry whilst the second set of communication circuitry 64 may comprise receiving circuitry 88.

As previously mentioned, the thermal protection circuit 66 is electrically coupled to the temperature sensor 38 by a pair of thermal protection circuit wires 56 that extend within the electrical cable 16 from the circuitry housing 12 to the heater housing 14. The thermal protection circuit 66 is also electrically coupled to the relay 68, which is located on the live wire of the pair of power supply wires 52. By removing the thermal protection circuit 66 and the relay 68 from the heater housing 14, a smaller and/or lighter heater housing 14 may be achieved. Furthermore, an RTD sensor may be comparatively smaller than, for example, a thermal fuse typically used in haircare appliances, and so use of an RTD sensor may provide a smaller and/or lighter heater housing 14.

The thermal protection circuit 66 comprises any appropriate circuitry for receiving a resistance value of the RTD temperature sensor 38, and controlling the relay 68 in response to the resistance value of the RTD temperature sensor 38. In such a manner, supply of current from the mains power supply to the heater elements 46 may be interrupted by the relay 68 in response to a resistance value of the RTD temperature sensor 38, for example where an over-temperature event occurs.

The exact architecture of the thermal protection circuit 66 may vary provided that it is sufficient to monitor the value provided by the RTD temperature sensor 38 and control the relay 68 in response. For example, the thermal protection circuit 66 may provide a comparator and a latch set in response to the comparator, with the latch controlling the relay 68. The comparator may compare a sensed value from the RTD temperature sensor 38 to a pre-determined limit, and set the value of the latch based on the comparison. The latch value may then control drive circuitry for opening and closing the relay 68. In some examples the relay 68 may comprise a one-time relay, such that opening of the relay requires maintenance of the haircare appliance 10, or indeed replacement of the haircare appliance 10.

In use, the heater controller 50 is able to control current flow to the heater elements 46, from the pair of power supply wires 52, using the heater drive circuitry 58 in response to commands input by a user using the user interface 32 and communicated to the heater controller 50 via the user interface controller 40, for example to raise or lower the temperature of the heater elements 46. The heater controller 50 is able to communicate with the airflow generator controller 72 over the pair of communication wires 54, with the airflow generator controller 72 controlling the airflow generator drive circuitry 70 to control flow of current to the airflow generator 36 along the pair of motor current wires 58, for example to increase or decrease airflow through the heater housing 14. Thus the heater controller 50, which may be considered a master controller for the haircare appliance 10, may be utilised to control both temperature and airflow provided by the haircare appliance 10 in use.

The RTD temperature sensor 38 is able to feedback the temperature of the heater elements 46, for example indirectly via a resistance measurement, to the thermal protection circuit 66 via the pair of thermal protection circuit wires 56, with the thermal protection circuit 66 controlling the flow of current from the mains power supply to the heater drive circuitry 58 along the pair of power supply wires 52.

As previously mentioned, removing the airflow generator control circuitry 60, the AC-DC converter 62, the thermal protection circuit 66, and the relay 68 from the heater housing 14, and locating these components in the circuitry housing 12, may enable the heater housing 14, which is intended to be grasped by a user in use, to be smaller and lighter, which may provide an improved user experience.

However, locating the above-mentioned components in the circuitry housing as opposed to the heater housing 14 may require a number of electrical connections to extend from the circuitry housing 12 to the heater housing 14, in the form of wires housed within the electrical cable 16. As the number of wires housed within the electrical cable 16 increases, so does the thickness of the electrical cable 16, and a thicker electrical cable 16 may be more rigid than a thinner electrical cable 16. A more rigid electrical cable 16 may provide less range of motion between the circuitry housing 12 and the heater housing 14, which may negatively impact a user experience when using the haircare appliance 10.

By utilising any or any combination of combined power and signalling wires, a single-phase motor, and a motor that utilises a "sensorless" control scheme, the number of wires needed to achieve the functionality described above may be kept to a minimum.

Indeed, by utilising the pairs of wires 52,54,56,58 and electrical connections described above, it has been found that the functionality described herein can be achieved whilst having no more than 8 wires extending from the circuitry housing 12 to the heater housing 14 in the electrical cable 16. This has been found to provide both the desired functionality and the flexibility of electrical cable 16 needed to provide an adequate user experience.

In view of the relatively large number of electrical connections extending from the circuitry housing 12 to the heater housing 14, in the form of the pairs of wires 52,54, 56,58 housed in the electrical cable 16, the electrical connections must be securely held to avoid failure of the haircare appliance 10 in use.

Figure 4:
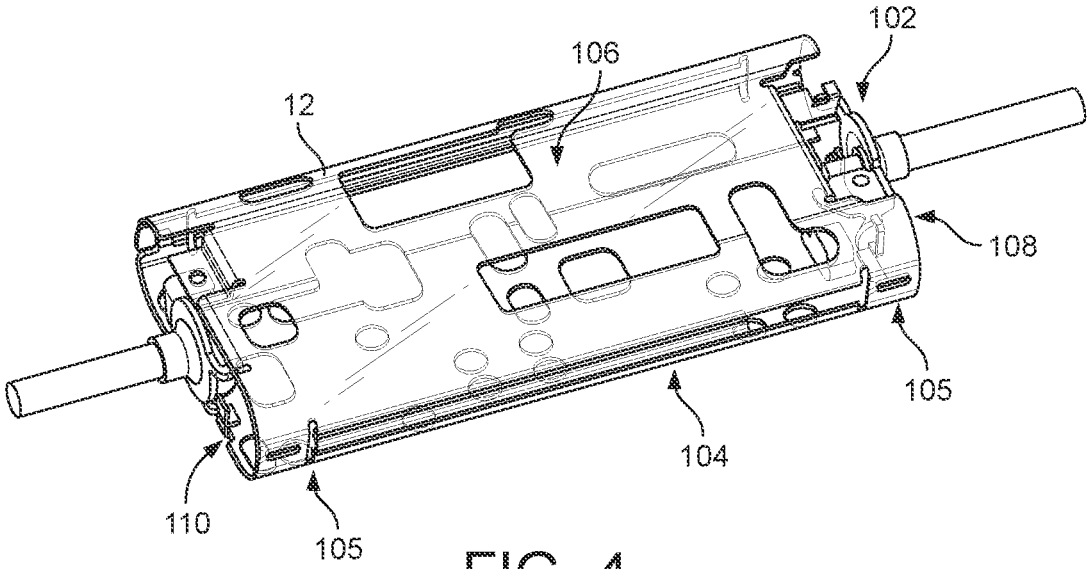
FIG. 4 is an enlarged view of a circuitry housing of the haircare appliance of FIG. 1.
Figure 6:
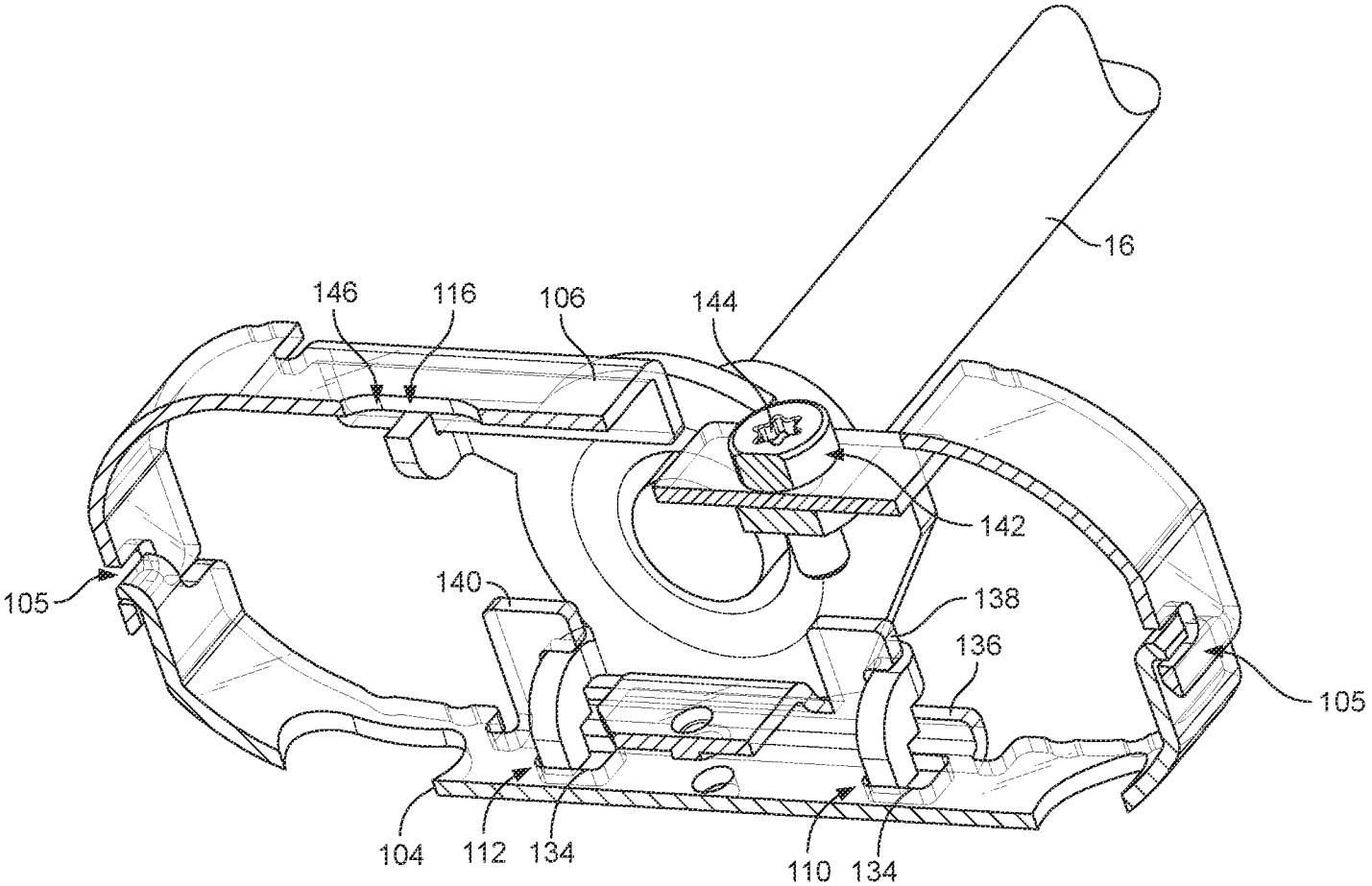
FIG. 6 is an enlarged view of a portion of the circuitry housing of FIG. 4 engaged with the attachment member of FIG. 5.

One such way of securely holding the electrical connections is to provide an attachment member 102 that attaches the electrical cable 16 to the circuitry housing 12, as shown in FIGS. 4 and 6.

As seen in FIG. 4, the circuitry housing 12 is generally cuboidal in form, although with curved vertices, such that the circuitry housing 12 has a first, lower, side 104 and a second, upper, side 106 opposite to the first side 104. Third 103 and fourth 107 sides of the circuitry housing 12 are defined by end faces extending between the first 104 and second 106 sides. The first 104 and second 106 sides of the circuitry housing 12 are formed as separate components held together by corresponding clips 105, with the third 108 and fourth 110 sides added to the circuitry housing 112 once the first 104 and second 106 sides have been clipped together and the attachment member 102 has been engaged with the circuitry housing 12. As will be described hereafter, the attachment member 102 engages both the first 104 and second 106 sides of the circuitry housing 12 to provide a secure connection between the electrical cable 16 and the circuitry housing 12.

Figure 5:
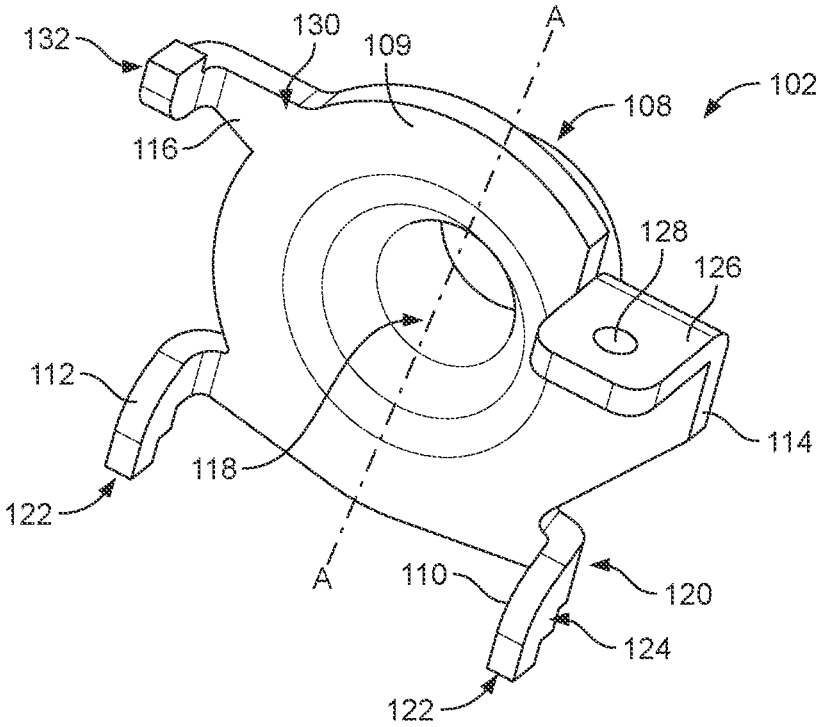
FIG. 5 is a perspective view of an attachment member utilised in the haircare appliance of FIG. 1.

The attachment member 102 is shown in isolation in FIG. 5. The attachment member 102 comprises a main body 108, and first 110, second 112, third 114 and fourth 116 arms extending from the main body 108. The main body 108 is generally conical in form with a circular base 109, and a bore 118 is disposed centrally on the main body 108, ie centrally on the circular base 109. The bore 118 is shaped and dimensioned to receive the electrical cable 16 therein, for example via a friction fit sufficient to retain the electrical cable 16 within the bore 118 when a force is applied to the electrical cable 16 in use.

Each of the first 110, second 112, third 114 and fourth 116 arms are formed integrally with the main body 108, such that the attachment member 102 comprises a monolithic structure. The attachment member 102 is formed of a metallic material, which may allow for both rigidity and thermal conductivity.

Each of the first 110 and second 112 arms comprises a similar structure, and extends outwardly from the main body 108 in a lateral direction in a plane parallel to the bore 118 as seen in FIG. 5, before extending in a direction orthogonal to the main body 108 and curving downwardly to again extend in a plane parallel to the bore 118 as seen in FIG. 5. Thus each of the first 110 and second 112 arms has a respective first end 120 attached to the main body 108, and a respective second end 122 which is a free end and can engage with the first side 104 of the circuitry housing 12.

A first side of each of the first 110 and second 112 arms comprises a smooth curve, whilst a second opposing side, a lower side as seen in FIG. 5, of each of the first 110 and second 112 arms comprises a respective engagement feature in the form of a step 124 shaped to engage a lip 136 extending upwardly from the first side 104 of the circuitry housing 12, as seen in FIG. 6. The first side of each of the first 110 and second 112 arms is configured to engage a respective engagement clip 138,140 extending from the first side 104 of the circuitry housing 12, as seen in FIG. 6.

As seen in FIG. 5, the bore 118 comprises a central axis A-A extending through a centre-point of the bore 118, with the first arm 110 located on a first side of the bore 118, ie a first side of the central axis A-A, and the second arm 112 located on a second opposing side of the bore 118, ie a second side of the central axis A-A. The first 110 and second 112 arms are spaced equidistantly from the central axis A-A, which may provide an even distribution of forces when the attachment member 102 is engaged with the circuitry housing 12.

The third arm 114 extends outwardly from the main body 108 in a lateral direction in a plane parallel to the bore 118 as seen in FIG. 5, before extending in a direction orthogonal to the main body 108. The third arm 114 has a planar portion 126 which is substantially parallel to the second side 106 of the circuitry housing 12 when the attachment member 102 is engaged with the circuitry housing. The planar portion 126 comprises a through-hole 128 for receiving a fastener 144 to engage the third arm 114 with the second side 106 of the circuitry housing 12.

The third arm 114 is located on the main body 108 substantially opposite to the first arm 110, with the through-hole 128 located substantially opposite to the second end 122 of the first arm 110. In such a manner regions of engagement of the first 110 and third 114 arms with the circuitry housing 12 may be located substantially opposite one another, as will be discussed in more detail hereafter.

Similarly to the first 110 and second 112 arms, the fourth arm 116 extends outwardly from the main body 108 in a lateral direction in a plane parallel to the bore 118 as seen in FIG. 5, before extending in a direction orthogonal to the main body 108 and curving upwardly to again extend in a plane parallel to the bore 118 as seen in FIG. 5. Thus the fourth arm 116 has a first end 130 attached to the main body 108, and a second end 132 which is a free end and can engage with the second side 106 of the circuitry housing 12.

The third arm 114 is located on a first side of the bore 118, ie a first side of the central axis A-A, and the fourth arm 116 is located on a second opposing side of the bore 118, ie a second side of the central axis A-A. The third 114 and fourth 116 arms are spaced equidistantly from the central axis A-A, which may provide an even distribution of forces when the attachment member 102 is engaged with the circuitry housing 12.

The fourth arm 116 is located on the main body 108 substantially opposite to the second arm 112, with the second end 132 of the fourth arm 116 located substantially opposite to the second end 122 of the second arm 112. In such a manner regions of engagement of the second 112 and fourth 116 arms with the circuitry housing 12 may be located substantially opposite one another, as will be discussed in more detail hereafter.

In the manner described above, the first 110, second 112, third 114 and fourth 116 arms are distributed about the periphery of the main body 108, and, when engaged with the circuitry housing 12, may provide a secure engagement that inhibits separation of the attachment member 102, and hence the electrical cable 16 held within the bore 118, from the circuitry housing 12 in the presence of an applied force in use, for example a force applied in a longitudinal direction of the electrical cable 16.

The engagement between the attachment member 102 and the circuitry housing 12 can be seen in FIG. 6.

The first side 104 of the circuitry housing 12 has two locating features in the form of apertures 134 within which the second ends 122 of the first 110 and second 112 arms are respectively received. In the presence of an applied force in a plane parallel to the first side 104 of the circuitry housing 12, the second ends 122 of the first 110 and second 112 arms engage with the periphery of the apertures 134 to inhibit removal of the attachment member 102, and hence the electrical cable 16, from the circuitry housing 12.

The first side 104 of the circuitry housing 12 also comprises a lip 136 extending upwardly from the circuitry housing, with the lip 136 defining a flat surface that engages with the steps 124 of the first 110 and second 112 arms. In the presence of an applied force in a plane parallel to the first side 104 of the circuitry housing 12, the engagement of the steps 124 with the lip 126 inhibits removal of the attachment member 102, and hence the electrical cable 16, from the circuitry housing 12.

The first side 104 of the circuitry housing further comprises first 138 and second 140 engagement clips that engage upper surfaces of the first 110 and second 112 arms as seen in FIG. 6. The first 138 and second 140 engagement clips are generally L-shaped in form, and in the presence of an applied force in a plane orthogonal to the first side 104 of the circuitry housing 12, for example a force applied in a direction between the first side 104 and the second side 106 of the circuitry housing 12, the engagement of the engagement clips 138,140 with the first 110 and second 112 arms inhibits removal of the attachment member 102, and hence the electrical cable 16, from the circuitry housing 12.

The second side 106 of the circuitry housing 12 comprises a through-hole 142 aligned with the through-hole 128 of the third arm 114 of the attachment member 102. A fastener 144 in the form of a screw extends through the through-holes 128,142 and acts to engage the second arm 112 of the attachment member 102 with the second side 106 of the circuitry housing 12. The fastener 144 inhibits removal of the attachment member 102, and hence the electrical cable 16, from the circuitry housing 12, in the presence of applied forces in both directions in planes parallel and orthogonal to the second side 106 of the circuitry housing 12. The through-holes 128,142 are aligned with one of the apertures 134 of the first side 104 of the circuitry housing 12, such that engagement of the first 110 and third 114 arms with respective first 104 and second 106 sides of the circuitry housing 12 are opposite one another.

The second side 106 of the circuitry housing 12 further comprises a locating feature in the form of an aperture 146 within which the second end 132 of the fourth arm 116 is received. In the presence of an applied force in a plane parallel to the second side 106 of the circuitry housing 12, the second end 132 of the fourth arm 116 engages with the periphery of the aperture 146 to inhibit removal of the attachment member 102, and hence the electrical cable 16, from the circuitry housing 12.

The aperture 146 of the second side 106 of the circuitry housing 12 is aligned with one of the apertures 134 of the first side 104 of the circuitry housing 12, such that engagement of the second 112 and fourth 116 arms with respective first 104 and second 106 sides of the circuitry housing 12 are opposite one another.

The engagement of the attachment member 102 with the circuitry housing 12 as described above may provide a secure engagement of the electrical cable 16 to the circuitry housing 12, which may ensure that the electrical connections held within the electrical cable, ie the pairs of wires 52,54, 56,58, are securely held to avoid failure of the haircare appliance 10 in use.

As the first 110 and second 112 arms are engaged with the first side 104 of the circuitry housing 12, and the third 114 and fourth 116 arms are engaged with the second side 106 of the circuitry housing 12, forces may be evenly distributed between the first 104 and second 106 sides of the circuitry housing 12 in the presence of an applied force on the electrical cable 16, and hence on the attachment member 102, in use. This may be beneficial where, for example, the first 104 and second 106 sides of the circuitry housing are defined by separate components attached to one another.

The attachment member 102 described above may also create space within the circuitry housing 12 as the arms 110,112,114,116 extend from the main body 108 into the interior of the circuitry housing 12 to engage with the circuitry housing 12, whilst the main body 108 is located at a periphery of the circuitry housing 12.

Figure 7:
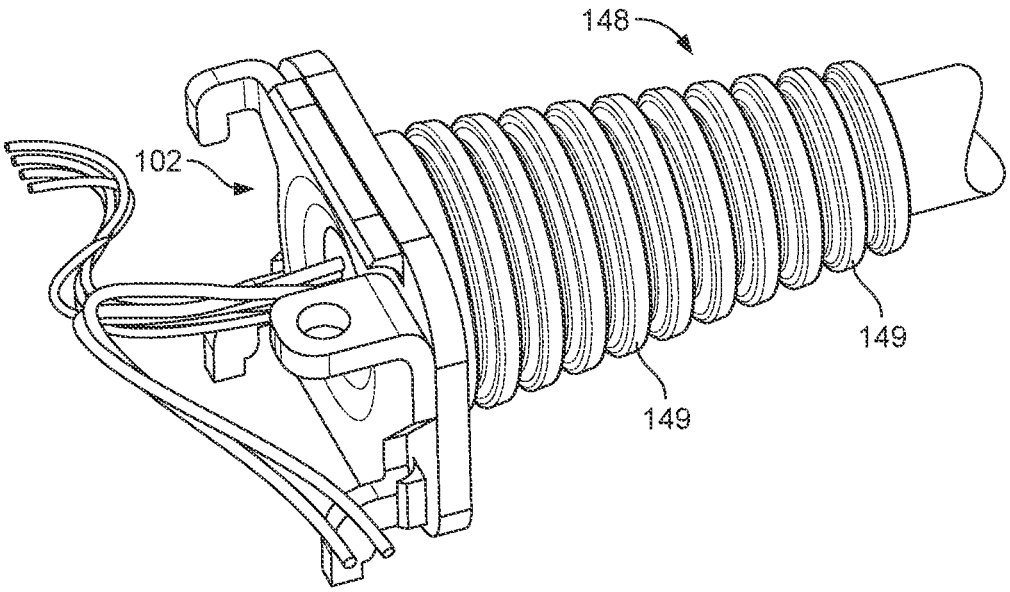
FIG. 7 is a schematic view illustrating a stress-release feature used in conjunction with the attachment member of FIG. 5.

To further mitigate forces applied to the electrical cable 16 in use, a stress release feature 148 is overmoulded onto the attachment member 102, as shown in FIG. 7. The stress release feature 148 comprises a plurality of spaced apart ribs 149 which are each configured to deform and contact an adjacent rib 149 in the presence of an applied force to the electrical cable 16.

As mentioned above, in view of the relatively large number of electrical connections extending from the circuitry housing 12 to the heater housing 14, in the form of the pairs of wires 52,54,56,58 housed in the electrical cable 16, the electrical connections must be securely held to avoid failure of the haircare appliance 10 in use.

Figure 11:
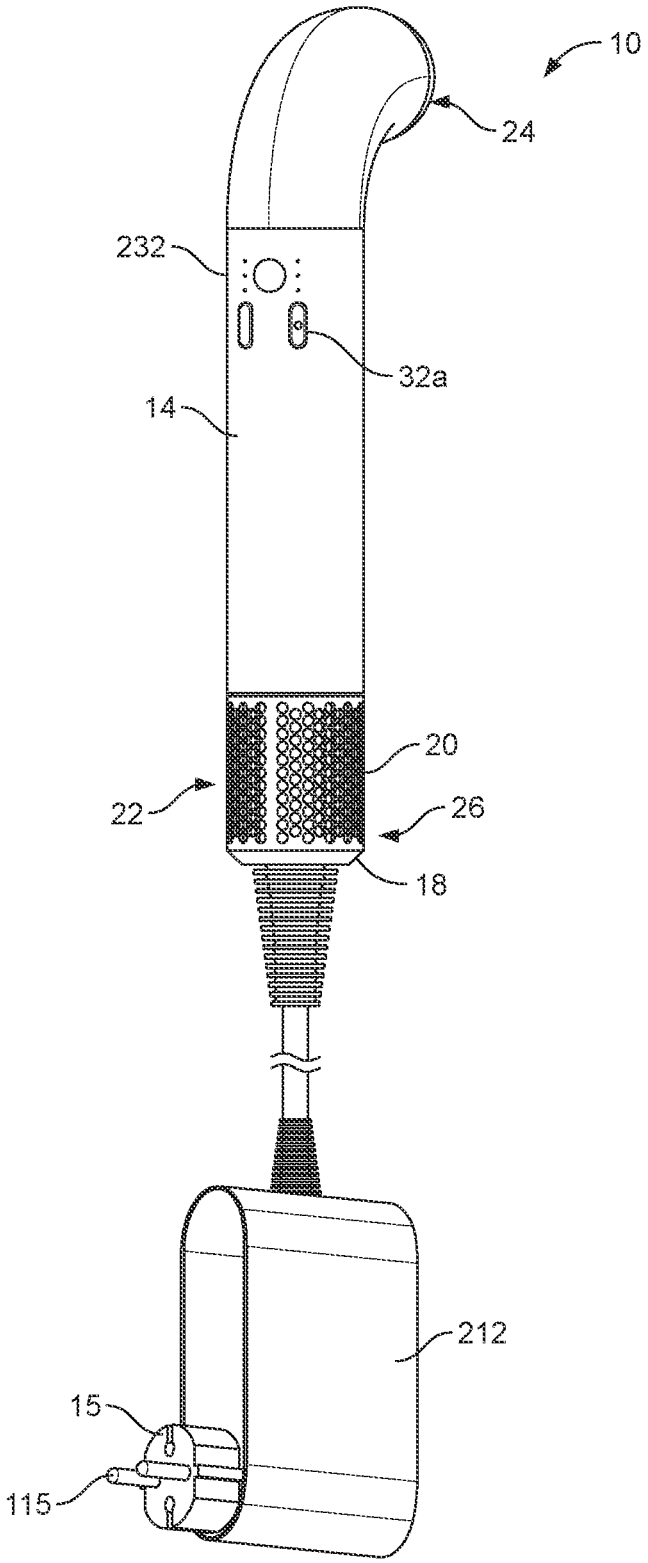
FIG. 11 is a perspective view of an alternative circuitry housing of the haircare appliance of FIG. 1.

In an alternative embodiment shown in FIG. 11, the circuitry housing 212 is integrally formed with the power connector 15. In this particular version, the power connector 15 is not formed as a unitary part of the circuitry housing 212, rather it is a separate part allowing for different power connectors to be used dependent on the territory the appliance is to be used in.

Figure 8:
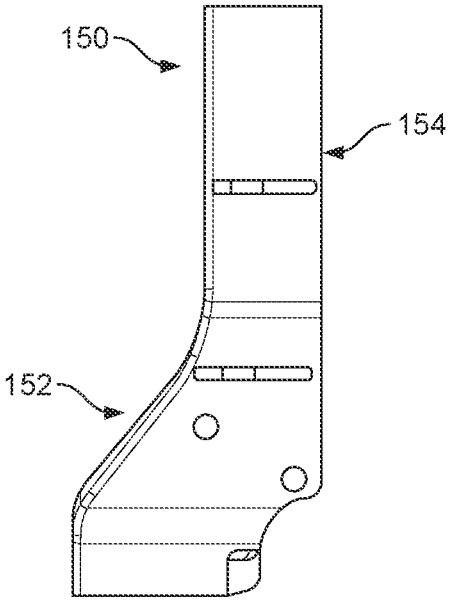
FIG. 8 is a perspective view of a wire guide utilised in the haircare appliance of FIG. 1.

Another such way of securely holding the electrical connections is to provide a wire guide 150 that holds the pairs of wires 52,54,56,58 within the heater housing 14, as shown in FIG. 8.

As can be seen in FIG. 8, the wire guide 150 comprises a first portion 152 and a second portion 154, with the first portion 152 obliquely angled relative to the second portion 154. The wire guide 150 is overmoulded onto the pairs of wires 52,54,56,58, for example during manufacture, such that the wire guide 150, and hence the first 152 and second 154 portions, comprise a monolithic structure, and the pairs of wires 52,54,56,58 are securely held by the wire guide 150. The wire guide 150 may then be inserted into the heater housing 14 along with the pairs of wires 52,54,56,58, which may provide for ease of manufacture compared to, for example, an arrangement where wires of the pairs of wires 52,54,56,58 are individually inserted into apertures of a wire guide. The material of the wire guide 150 has a Shore A hardness in the region of 40-60, preferably around 50. This may provide a reasonable compromise between rigidity and flexibility for the wire guide 150. For example, a relatively rigid wire guide 150 may be problematic for insertion of the wire guide 150 into the heater housing 14 during manufacture, whilst risk of separation of wires from the wire guide 150 may be increased where the wire guide 150 is relatively flexible.

The wire guide 150 is shaped such that there is a curved transition between the first 152 and second 154 portions, which may provide the wire guide 150 with greater structural integrity than, for example, a wire guide comprising a sharp transition between the first 152 and second 154 portions.

Figure 9:
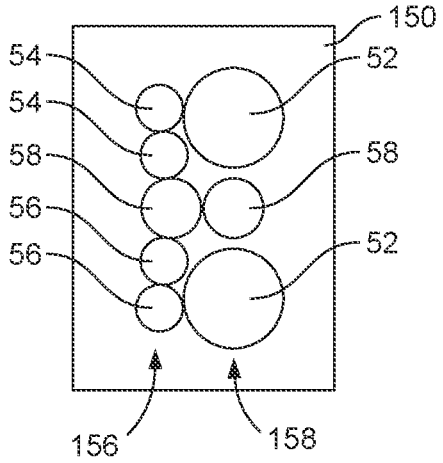
FIG. 9 is a schematic end view of the wire guide of FIG. 8.

The wire guide 150 holds the pairs of wires 52,54,56,58 in first 156 and second 158 rows, as can be seen in FIG. 9, which is a schematic view illustrating an end of the wire guide 150. The first row 156 comprises the pair of communication wires 54, the pair of thermal protection circuit wires 56, and one of the pair of motor current wires 58. The second row 158 comprises the pair of power supply wires 52 and the other one of the pair of motor current wires 58. Each wire of the pair of communication wires 54 and the pair of thermal protection circuit wires 56 has a diameter of around half the diameter of each wire of the pair of power supply wires 52, such that the first 156 and second 158 rows have substantially the same length. This may provide a relatively compact array for the pairs of wires 52,54,56,58, which may reduce space taken up by the wire guide 150 within the heater housing 14, thereby enabling more space for, for example, an airflow channel within the heater housing 14.

The wires of the pair of communication wires 54 are disposed adjacent one another in the first row 156, and the wires of the pair of thermal protection circuit wires 56 are disposed adjacent one another in the first row 156, with the one of the pair of motor current wires 58 intermediate the pair of communication wires 54 and the pair of thermal protection circuit wires 56 in the first row 156. The other of the pair of motor current wires 58 is located intermediate wires of the pair of power supply wires 52 in the second row 158, with the wires of the pair of motor current wires 58 adjacent to one another between the first 156 and second 158 rows. The orientation of wires within the heater housing 14 will, of course, depend on the layout of components within the heater housing 14, but a compact array of wires has been achieved in the manner described above.

Figure 10:
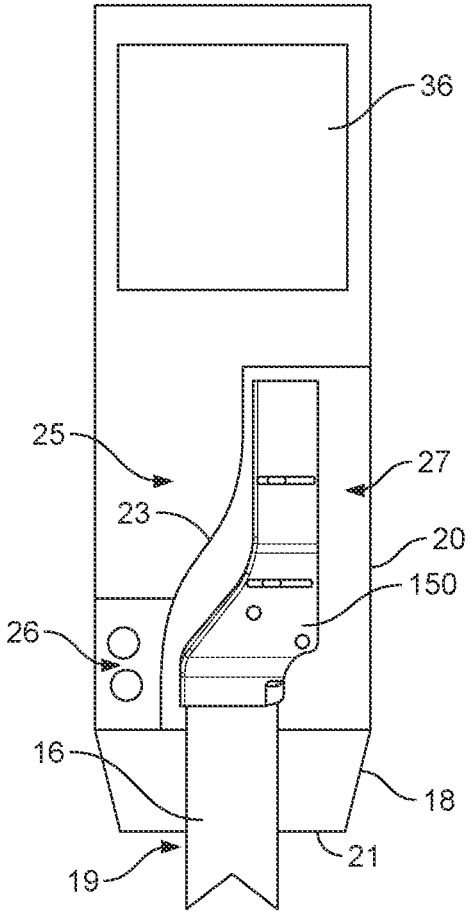
FIG. 10 is a schematic view illustrating a position of the wire guide of FIG. 8 within the haircare appliance of FIG. 1.

The location of the wire guide 150 within the heater housing 14 is shown schematically in FIG. 10.

As mentioned above, the heater housing 14 defines a hollow, generally elongate, handle that is intended to be grasped by a user in use. The heater housing 14 comprises a conical end portion 18 and a wall 20 extending upwardly from the conical end portion 18, such that a first end 22 of the heater housing 14 is generally cylindrical in form. An aperture 19 is formed centrally on a base 21 of the conical end portion 18, and the electrical cable 16, and hence the pairs of wires 52,54,56,58, extends through the aperture into the interior of the heater housing 14. The heater housing 14 comprises an internal wall 23 that splits the interior of the heater housing 14 into an airflow path 25 extending from the air inlet 26 and a channel 27 sealed from the airflow path 25.

The wire guide 150 is disposed in the channel 27, such that the wire guide 150 is not located within the airflow path 25. This may provide greater flexibility in choice of shape for the wire guide 150, and may also improve airflow characteristics through the airflow path 25. The wire guide 150 is also disposed in the channel 27 such that the first portion 152 of the wire guide 150 extends in a direction from the aperture, and hence also from the base 21, toward the wall 20. The second portion 154 of the wire guide 150 extends parallel to the wall 20. In such a manner, the wire guide 150 guides the pairs of wires 52,54,56,58 from the aperture 19 toward the wall 20. This may create space within the heater housing 14 for the airflow path 25, and may allow for the airflow path 25 to have a more desirable shape than, for example, a space provided were the wire guide 150 to extend solely upwardly from the aperture 19, ie orthogonally from the plane of the aperture 19. The wire guide 150 may also inhibit separation of the pairs of wires 52,54,56,58 from the heater housing 14, for example when a force is applied in a direction orthogonal to the plane of the aperture 19 in use, for example a pulling force applied to the pairs of wire 52,54,56,58 in a direction away from the heater housing 14. For example, the wire guide 150 may engage with the end portion 18, for example the base 21, of the heater housing 14 to inhibit separation of the plurality of wires 52,54,56,58 from the heater housing 14.

In the embodiment of FIG. 10, the wire guide 150 engages with the end portion 18 via a clamp 160. The clamp 160 is annular in form, and has a diameter substantially corresponding to a width of the wire guide 150, or alternatively slightly less than a width of the wire guide 150, such that the wire guide 150 is held within the clamp 160. The clamp 160 then engages the end portion 18 about the periphery of the aperture 19 via an annular abutment portion 162 to inhibit separation of the plurality of wires 52,54,56,58 from the heater housing 14.

The haircare appliance 10 described above may provide a lighter and/or smaller, and hence more user-friendly, heater housing 14, whilst at the same time providing secure electrical connections between the circuitry housing 12 and the heater housing 14, without compromising on relative motion between the heater housing 14 and the circuitry housing 12 when the heater housing 14 is grasped and moved by a user in use.

The invention claimed is:

1. A haircare appliance comprising a heater housing, a heater assembly disposed in the heater housing, a circuitry housing remote from the heater housing, an electronic component disposed in the circuitry housing, an electrical cable extending from the circuitry housing to the heater housing, a wire disposed within the electrical cable, the wire connecting the electronic component to the heater assembly, and an attachment member attaching the electrical cable to the circuitry housing, wherein the attachment member comprises a main body having a bore within which the electrical cable is held, and a first arm and a second arm extending from the main body, the first arm engaged with a first side of the circuitry housing, and the second arm engaged with a second side of the circuitry housing, the second side of the circuitry housing opposite to the first side of the circuitry housing.

2. The haircare appliance as claimed in claim 1, wherein the first side of the circuitry housing comprises a locating feature, and the first arm is received within the locating feature such that motion of the attachment member relative to the circuitry housing in a direction parallel to a longitudinal extent of the electrical cable is inhibited.

3. The haircare appliance as claimed in claim 2, wherein the locating feature comprises a recess or aperture formed in the first side of the circuitry housing, and the first arm is located in the recess or aperture.

4. The haircare appliance as claimed in claim 1, wherein the second arm is engaged with the second side of the circuitry housing by a fastener extending through the second arm and the second side of the circuitry housing.

5. The haircare appliance as claimed in claim 1, wherein a region of engagement between the first arm and the first side of the circuitry housing is located opposite a region of engagement between the second arm and the second side of the circuitry housing.

6. The haircare appliance as claimed in claim 1, wherein the circuitry housing defines an internal cavity, the main body is located at a perimeter of the circuitry housing, and the first and second arms extend into the internal cavity from the main body.

7. The haircare appliance as claimed in claim 1, wherein the first arm comprises a first end attached to the main body, a second end engaged with the first side of the circuitry housing, and the first arm is curved between the first and second ends.

8. The haircare appliance as claimed in claim 1, wherein the first arm comprises an engagement feature, and the first side of the circuitry housing comprises a lip extending upwardly from an inner surface of the first side of the circuitry housing, the engagement feature engaged with the lip such that motion of the attachment member relative to the circuitry housing in a direction parallel to a longitudinal extent of the electrical cable is inhibited.

9. The haircare appliance as claimed in claim 1, wherein the first side of the circuitry housing comprises an engagement clip, the first arm held by the engagement clip such that motion of the attachment member is inhibited in a direction from the first side of the circuitry housing to the second side of the circuitry housing.

10. The haircare appliance as claimed in claim 1, wherein the circuitry housing comprises a first portion defining the first side of the circuitry housing, a second portion defining the second side of the circuitry housing, and the first arm being engaged with the first side of the circuitry housing, and the second arm being engaged with the second side of the circuitry housing, inhibits separation of the first portion and the second portion.

11. The haircare appliance as claimed in claim 1, wherein the attachment member comprises a plurality of first arms engaged with the first side of the circuitry housing.

12. The haircare appliance as claimed in claim 11, wherein a first arm is located on a first side of the bore, and a second first arm is located on a second side of the bore opposite to the first side of the bore.

13. The haircare appliance as claimed in claim 1, wherein the attachment member comprises a third arm engaged with the second side of the circuitry housing, the third arm comprising substantially the same engagement mechanism as the first arm.

14. The haircare appliance as claimed in claim 1, wherein the attachment member and the circuitry housing each comprise a thermally conductive material.

15. An attachment member for attaching an electrical cable to a circuitry housing of a haircare appliance, the attachment member comprising a main body having a bore for holding the electrical cable, and a first arm and a second arm extending from the main body, the first arm for engagement with a first side of the circuitry housing, and the second arm for engagement with a second side of the circuitry housing, the second side of the circuitry housing opposite to the first side of the circuitry housing.

* * * * *